US009479862B2

(12) United States Patent
Yang

(10) Patent No.: US 9,479,862 B2
(45) Date of Patent: Oct. 25, 2016

(54) ACOUSTIC BOX STRUCTURE

(71) Applicant: FirstChair Acoustics Co., Ltd., Taoyuan, Taoyuan County (TW)

(72) Inventor: Ching-Wen Yang, Taoyuan (TW)

(73) Assignees: FirstChair Acoustics Co., Ltd., Taoyuan (TW); Ching-Wen Yang, Taoyuan (TW)

( * ) Notice: Subject to any disclaimer, the term of this patent is extended or adjusted under 35 U.S.C. 154(b) by 0 days.

(21) Appl. No.: 14/734,521

(22) Filed: Jun. 9, 2015

(65) Prior Publication Data

US 2016/0014487 A1 Jan. 14, 2016

(30) Foreign Application Priority Data

Jul. 8, 2014 (TW) ..... 103212103 U

(51) Int. Cl.
*H04R 1/02* (2006.01)
*H04R 1/28* (2006.01)
*H04R 1/26* (2006.01)

(52) U.S. Cl.
CPC ..... *H04R 1/2888* (2013.01); *H04R 1/2857* (2013.01); *H04R 1/26* (2013.01); *H04R 2420/09* (2013.01)

(58) Field of Classification Search
CPC ..... H04R 5/02; H04R 1/02; H04R 1/025; H04R 1/026
USPC ..... 381/301, 304, 332–336, 386, 388, 395
See application file for complete search history.

(56) References Cited

U.S. PATENT DOCUMENTS 6,925,188 B1 * 8/2005 Markow ..... G06F 1/1616 381/306
7,076,078 B2 * 7/2006 Peng ..... G06F 1/1605 348/E5.128
7,995,786 B2 * 8/2011 Yu ..... H04R 1/025 381/333
8,411,892 B2 * 4/2013 Grundland ..... H04R 1/2861 381/301

* cited by examiner

*Primary Examiner* — Suhan Ni
(74) *Attorney, Agent, or Firm* — C. G. Mersereau; Nikolai & Mersereau, P.A.

(57) ABSTRACT

The present invention provides an acoustic box structure comprising a main body having a cover and a base with a cut-out slot, and formed of a hollow cavity constructed by the cover and the base with a pair of side panels; a modular supporting plate formed by side plates extended vertically from lateral sides of a substrate and comprising a top plate extended vertically therefrom, and disposed inside the hollow cavity; a circuit main board comprising a processor, sockets and terminals, and disposed on the modular supporting plate; an acoustic box connecting board comprising the terminals and the terminals electrically coupled thereto, and inserted into the cut-out slot; a speaker module comprising at least one speaker compartment on the base member and comprising terminals corresponding to the sockets of the modular supporting plate. Accordingly, the acoustic box structure of the present invention can be facilitated for assembly with increased diversity.

15 Claims, 7 Drawing Sheets

510

ACOUSTIC BOX STRUCTURE

FIELD OF THE INVENTION

The present invention is related to an acoustic box structure, in particular, to an improved acoustic box structure capable of increasing the assembly, maintainability and diversity thereof as well as reducing the noises generated.

BACKGROUND OF THE INVENTION

For the acoustic box structures of the earlier days, their assembly method mainly relies in fastening a speaker compartment onto an acoustic box structure, followed by connecting the power cords of the speaker compartment to the external power supply or connecting the power cords onto the acoustic box structure in order to allow the sound generated by the speaker compartment to produce the effects of lower frequency or higher sound quality via the acoustic box structure.

However, the traditional assembly method is known to have at least the following drawbacks. For example, in the case where there are more than one speaker compartments, the number of power cords connected to the speaker compartments also increases; for a common solution, the power cords are typically wrapped and coiled in order to be placed at parts not interferencing with the actuations of the speaker compartments and the acoustic box structure. However, such method can still be affected by the actuation of the speaker compartments in a long term, and the power cords then become loose or affected due to the vibrations of the power cords; consequently, it causes the problem of interferencing the sound quality thereof. An improvement method to such problem is to provide a sound-absorbing cotton placed inside the speaker compartment or disposed between the acoustic box structure and the power cords in order to reduce the inferences of the power cords on the sound quality. Despite the fact that such method may reduce the interference on the sound quality, nevertheless, there is a need to introduce a numerous steps in the manufacturing process in order to properly layout the position for the power cords and to suitably arrange the positions of the sound-absorbing cotton inside the acoustic box structure. As a result, such method introduces further burdens to the manufacturing costs and the time management of the manufacturing process of the device.

In view of the aforementioned shortcomings of the prior arts, the present invention provides an improved acoustic box structure, seeking to eliminate the problem associated with the organization and layout of the power cords by utilizing the design concept of an insertion type connecting structure, in order to achieve the objectives of fast assembly, facilitated maintenance and diversity in the speaker compartments.

SUMMARY OF THE INVENTION

In view of the aforementioned drawbacks, an objective of the present invention is to provide an improved acoustic box structure capable of overcoming the shortcomings of the prior arts.

The present invention provides an acoustic box structure comprising an acoustic box main body, a modular supporting plate, a circuit main board, an acoustic connecting board and a speaker module. The acoustic box main body comprises a cover member and a base member with a cut-out slot formed thereon, and the acoustic box main body is formed of a hollow cavity constructed by the cover member and the base member having a pair of side panels covered onto two lateral sides thereof; the modular supporting plate is formed by a pair of side plates extended vertically from two lateral sides of a substrate and comprises a top plate extended vertically from one of the plurality of side plates and the substrate correspondingly; the modular supporting plate is configured to be disposed inside the hollow cavity of the acoustic box main body; the circuit main board comprises a processor, a plurality of connecting sockets and a plurality of connecting terminals formed thereon, and the circuit main board is configured to be disposed on the modular supporting plate; the acoustic box connecting board comprises the plurality of connecting terminals, the plurality of connecting terminals electrically coupled to the plurality of connecting sockets on the circuit main board, and the acoustic box connecting board is configured to be inserted into the cut-out slot of the base member of the acoustic box main body; the speaker module comprises at least one speaker compartment, the at least one speaker compartment is configured to be fastened onto the base member of the acoustic box main body and comprises the plurality of connecting terminals corresponding to the plurality of connecting sockets of the modular supporting plate in order to be electrically coupled thereto. A primary objective of the present invention is to provide an improved acoustic box structure such that the modular supporting plate is provided with at least one circuit main board comprising a plurality of connecting sockets and a plurality of connecting terminals in order to allow the connecting bases and the connecting terminals to be electrically coupled to the speaker module; therefore, the advantageous effects of fast assembly and facilitated maintenance can be achieved.

Another objective of the present invention is to provide an improved acoustic box structure in which the acoustic box connecting board is provided, and the acoustic box connecting board extends from one end of the base member to another end thereof Accordingly, such configuration used for replacing the traditional power cord layout is able to overcome the inconvenience associated with the organization of the cords required in the prior art as well as to improve the interference caused by the vibrations of the power cords on the sound quality of the acoustic box.

DESCRIPTION OF EMBODIMENTS OF THE INVENTION

To understand the objectives, features and effects of the present invention, the following detailed description of the embodiment of the present invention is provided along with the accompanied drawings to further describe the present invention in greater detail as follows.

Figure 1:
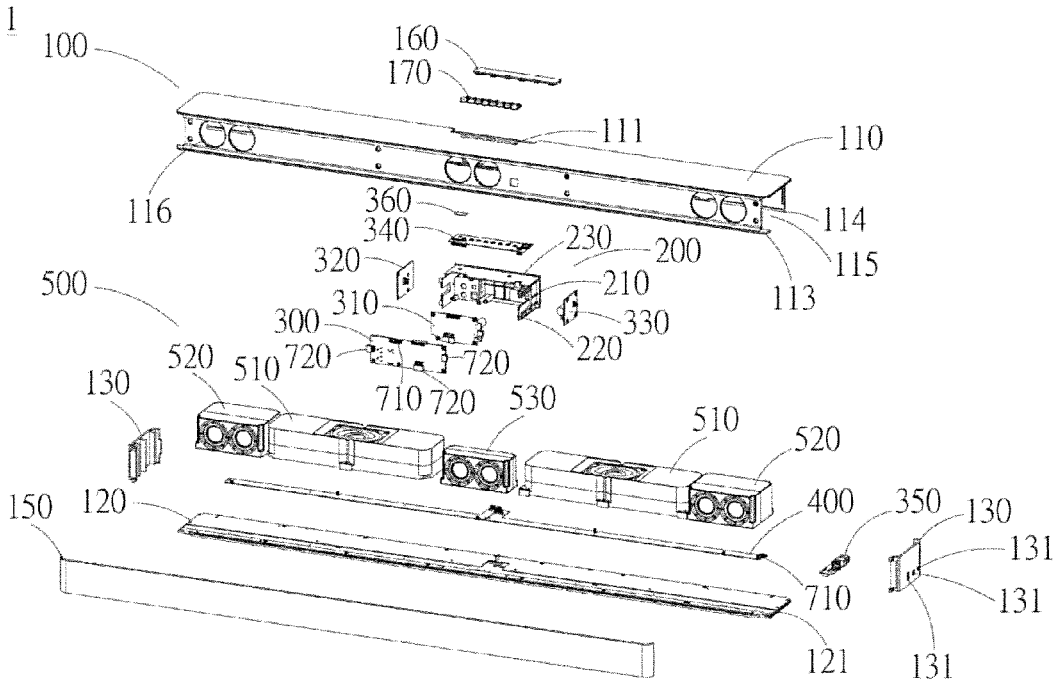
FIG. 1 is an exploded view of an acoustic box structure of the present invention.

Please refer to FIG. 1, showing an exploded view of an acoustic box structure of the present invention. The acoustic box structure 1 of the present invention comprises an acoustic box main body 100, a modular supporting plate 200, a circuit main board 300, an acoustic box connecting board 400 and a speaker module 500.

The acoustic box main body 100 comprises a cover member 110 and a base member 120 with a cut-out slot 121 formed thereon, and the acoustic box main body 100 is formed of a hollow cavity 115 constructed by the cover member 110 and the base member 120 having a pair of side panels 130 covered onto two lateral sides thereof. In addition, the cover member 110 can be stably attached onto the base member 120.

Wherein a top portion of the cover member 110 includes a plurality of slot holes 111 formed thereon, and the plurality of slot holes 111 are used for receiving a functional button securement plate 160 thereon in order to prevent dusts or foreign objects from entering into the hollow cavity 115. The functional button securement plate 160 is installed on the plurality of slot holes 111; in addition, the acoustic box main body 100 further comprises a functional button 170.

Wherein a front side and a rear side of a bottom portion of the cover member 110 respectively includes a front supporting slat 113 and a rear supporting slat 114 extended toward the hollow cavity 115. In addition, one side of the cover member 110 facing toward the front supporting slat 113 includes a plurality of sound holes 116. Furthermore, the acoustic box main body 100 further comprises a speaker mesh 150, and the speaker mesh 150 is arranged corresponding to the front supporting slat 113. The speaker mesh 150 can be a transparent type, a cross-hatch mesh type or any other type capable of enhancing the beauty of the appearance thereof Wherein one of the side panels 130 comprises at least one first insertion slot 131. In this embodiment, three first insertion slots 131 are formed on the side panel 131, and their functions are respectively as a USB-OUT connecting portion 351, a USB-IN connecting portion 352 and a 3.5 mm audio output hole connecting portion 353. However, it can be understood that in other embodiments, the first insertion slot 131 can further comprise any one of the following of a Secure Digital Memory Card (SD) card insertion slot, a Mini-USB insertion slot, a Micro-USB insertion slot and a combination thereof.

The modular supporting plate 200 is formed by a pair of side plates 220 extended vertically from two lateral sides of a substrate 210 and comprises a top plate 230 extended vertically from one of the side plates 220 and the substrate 210 correspondingly. The modular supporting plate 200 is configured to be disposed inside the hollow cavity 115 of the acoustic box main body 100.

The circuit main board 300 comprises a processor, a plurality of connecting sockets 720 and a plurality of connecting terminals 710 formed thereon, and the circuit main board 300 is configured to be disposed on the modular supporting plate 200.

The acoustic box connecting board 400 comprises the plurality of connecting terminals 710, and the plurality of connecting terminals 710 are electrically coupled to the connecting sockets 720 on the circuit main board 300. In addition, the acoustic box connecting board 400 is configured to be inserted into the cut-out slot 121 of the base member 120 of the acoustic box main body 100.

The speaker module 500 comprises at least one speaker compartment, the at least one speaker compartment is configured to be fastened onto the base member 120 of the acoustic box main body 100 and comprises the plurality of connecting terminals 710 corresponding to the plurality of connecting sockets 720 of the modular supporting plate 200 in order to be electrically coupled thereto. In this embodiment, the speaker compartments include a pair of third speaker compartments 510, a pair of second speaker compartments 520 and a first speaker compartment 530.

Figure 2:
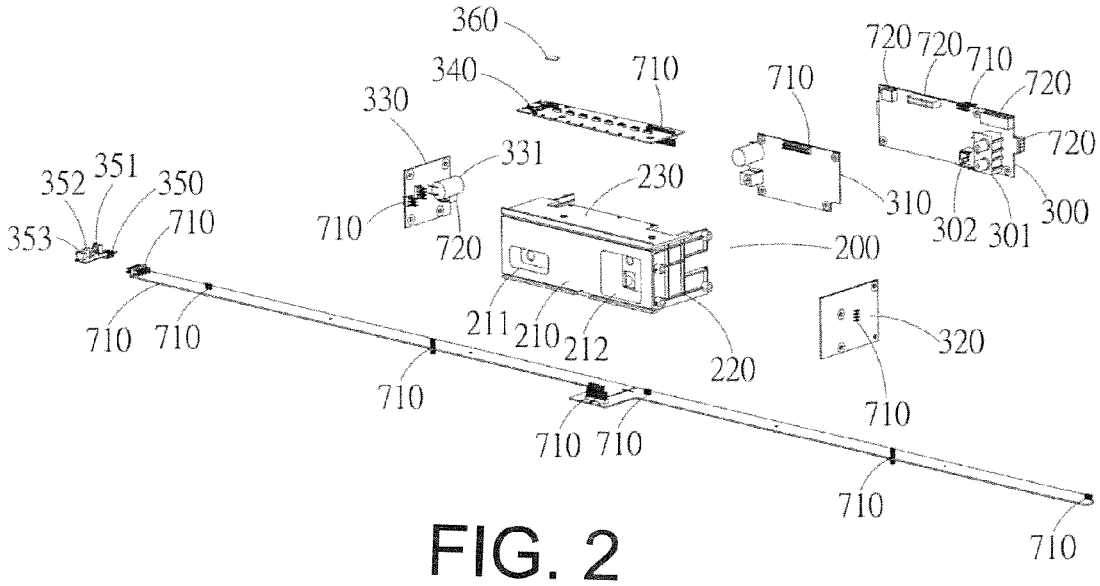
FIG. 2 is another exploded view of the acoustic box structure of the present invention.

Please refer to FIG. 2, showing another exploded view of the acoustic box structure of the present invention. In this embodiment, the substrate 210 includes at least one second insertion slot 211 and four third insertion slots 212 formed thereon, in which the second insertion slot 211 can be power socket while the plurality of third insertion slots 212 can be of the functions of an audio terminal insertion slot, a video terminal insertion slot and a USB terminal insertion slot; however, it can be understood that in other embodiments, the plurality of third insertion slots 212 can further comprise any one of the following of a VGA insertion slot, a HDMI insertion slot and a combination thereof.

The circuit main board 300 further comprises an amplifier (AMP) functional board 310, a wireless module panel 320, a power supply panel 330, an infrared receiver 331, a functional control board 340 and an input output interface board 350. In addition, the plurality of panels can be respectively formed of the plurality of connecting sockets 720 and the plurality of connecting terminals 710; the connecting sockets 720 and the connecting terminals 710 can be electrically coupled to each other in such a way that they can further form an electrical loop circuit with the circuit main board 300. Furthermore, the panels of different functions can be selected for uses based on the processor (not shown in the figure) of the circuit main board utilized. Moreover, the circuit main board 300 further comprises a NFC chipset 360, and the NFC chipset 360 is disposed on any one of the plurality of panels. Also, in this embodiment, the amplifier (AMP) functional board 310 includes a RCA input terminal connecting portion 301 and a 3.5 mm audio input hole connecting portion 302.

In addition, the plurality of panels can be arranged to have different positions according to a variation of the structure of the acoustic box main body 100. In this embodiment, the input output interface panel 350 can be directly connected to the plurality of connecting terminals 710 of the acoustic box connecting board 400. Furthermore, in this embodiment, the input output interface panel 350 includes the USB-OUT connecting portion, the USB-IN connecting portion 352 and the 3.5 mm audio input hole connecting portion 353.

Figure 3:
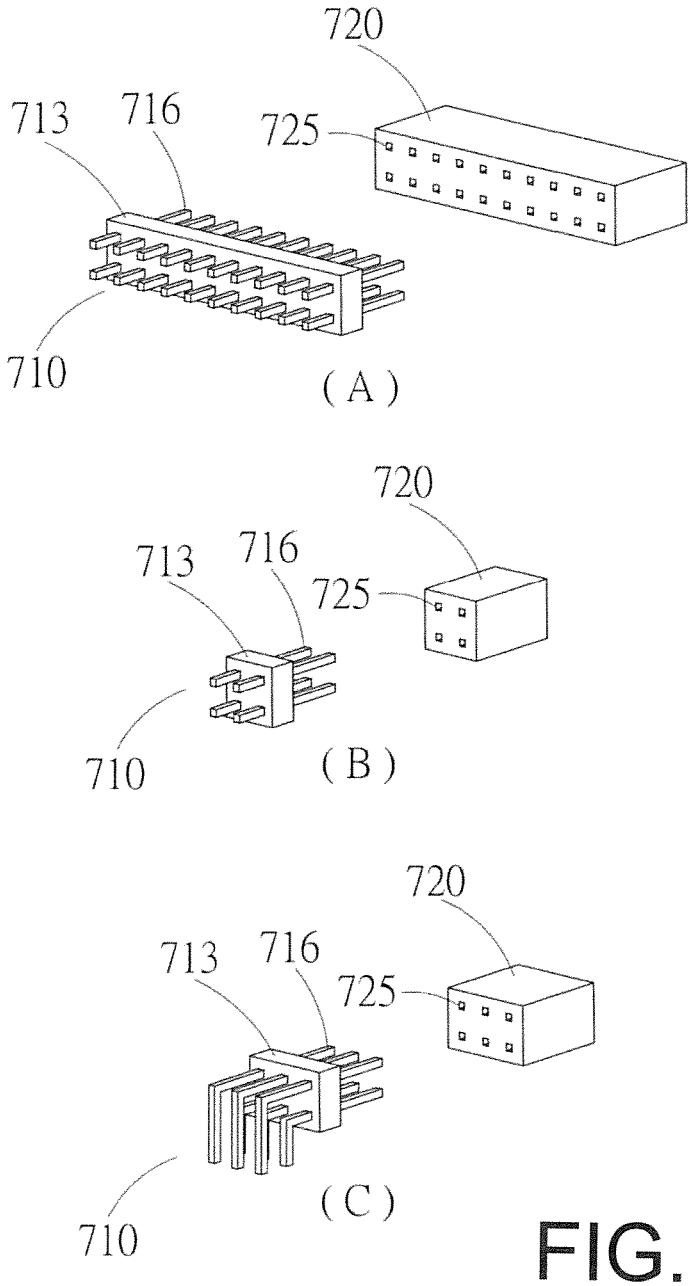
FIG. 3 shows illustrations of the connecting parts of the acoustic box structure of the present invention.

Nevertheless, the connection method adapted by the plurality of connecting sockets 720 and the plurality of connecting terminals 710 may refer to FIG. 3, in which illustrations showing connecting parts of the acoustic box structure of the present invention are presented. Each one of the connecting terminals 710 is mainly constructed by a terminal securement base 713 and a plurality of electrical terminals 716, whereas each one of the connecting sockets 720 mainly includes a plurality of terminal holes 725 formed thereon corresponding to the plurality of electrical terminals 716; therefore, by inserting the electrical terminals 716 into the terminal holes 725, the connecting sockets 720 can be electrically coupled to the connecting terminals 716.

In this embodiment, the connecting sockets 720 and the connecting terminals 710 can be configured to be of any shapes of, such as, rectangular shape, square shape, column shape and so on. In addition, the electrical terminals 716 can also be bent into different angles and shapes according to the panels attached thereto.

Figure 4:
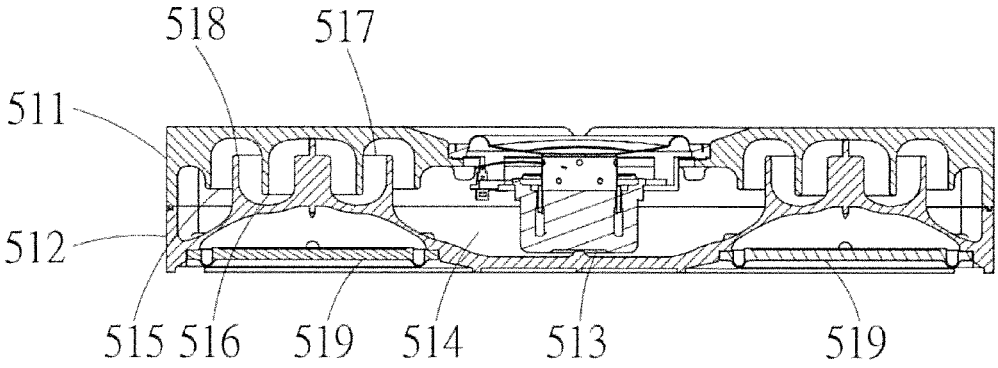
FIG. 4 is cross sectional view of a third speaker compartment of the acoustic box structure of the present invention.

Please refer to FIG. 4, showing of a cross sectional view of a third speaker compartment of the acoustic box structure of the present invention. The third speaker compartment 510 is formed by a speaker main body 513, a first resonance chamber 511 and a second resonance chamber 512.

The first resonance chamber 511 includes the speaker main body 513 disposed therein, and the first resonance chamber 511 also includes a pair of symmetrical outer sound guidance members 515. The second resonance chamber 512 is covered onto the first resonance chamber 511 and the speaker main body 513 in order to form a resonance enclosure 514 with the first resonance chamber 511. In addition, one side of the second resonance chamber 512 includes an inner sound guidance member 517 corresponding to the outer sound guidance member 515, and another side thereof includes a plurality of rear drum units 519 corresponding to the inner sound guidance member 517. Wherein, the outer sound guidance member 515 and the inner sound guidance member 517 respectively include a plurality of protruding structures 516, 518 arranged spaced apart from each other in curved shapes. Furthermore, the protruding structures 516 of the outer sound guidance member 515 face toward the protruding structures 518 of the inner sound guidance member 517 in such a way that they are not interferencing with each other while forming the curved and winding channels.

It shall be noted that during the generation of the sound by the acoustic box main body 100 due to vibrations, the sound is transmitted to the resonance chamber 514 and also enters into the curved and winding channels formed by the plurality of protruding structures 516, 518 such that the sound is further transmitted out of the acoustic box main body 100 via the plurality of rear drum units 519.

Figure 5:
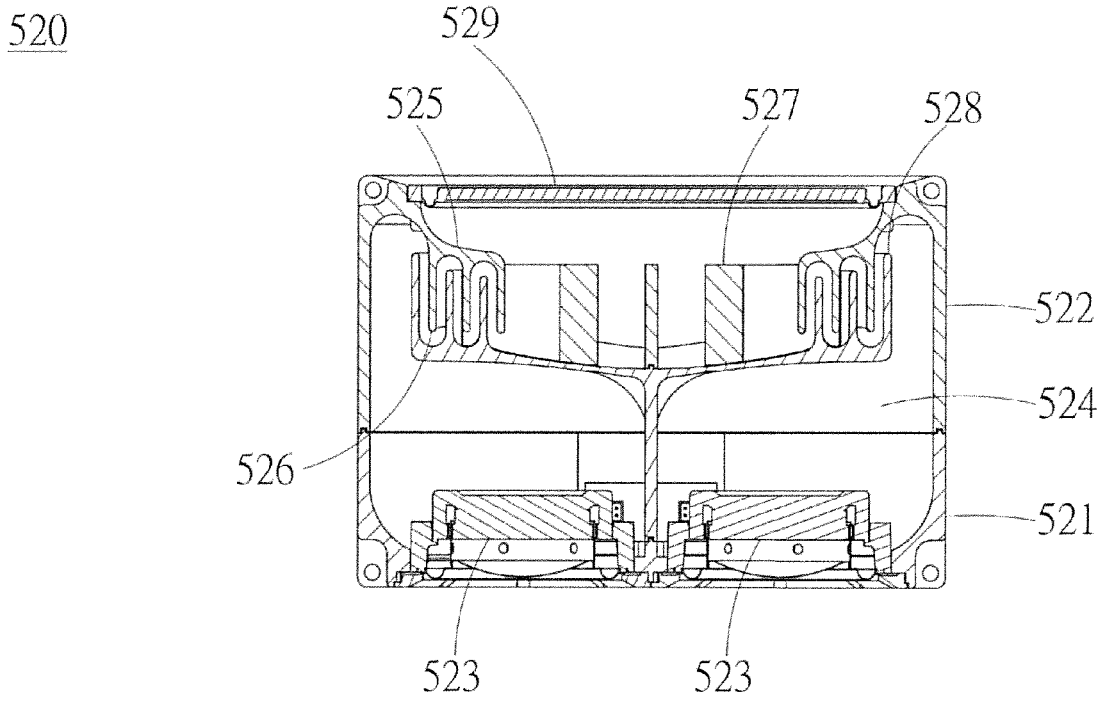
FIG. 5 is cross sectional view of a second speaker compartment of the acoustic box structure of the present invention.

Please refer to FIG. 5, showing of a cross sectional view of a second speaker compartment of the acoustic box structure of the present invention. The actuation principle of the second speaker compartment 520 is generally identical to that of the third speaker compartment 510, and the two differs in that the second speaker compartment 520 is mainly constructed by at least one speaker main body 523, a first resonance chamber 521 and a second resonance chamber 522.

The first resonance chamber 521 includes the plurality of speaker main bodies 523 disposed therein, and the first resonance chamber 521 also includes an outer sound guidance member 525. The second resonance chamber 522 is covered onto the first resonance chamber 521 and the speaker main bodies 523 in order to form a resonance enclosure 524 with the first resonance chamber 521. In addition, one side of the second resonance chamber 522 includes an inner sound guidance member 527 corresponding to the outer sound guidance member 525, and another side thereof includes a rear drum unit 529 corresponding to the inner sound guidance member 527. Wherein, the outer sound guidance member 525 and the inner sound guidance member 527 respectively include a plurality of protruding structures 526, 528 arranged spaced apart from each other in curved shapes. Furthermore, the protruding structures 526 of the outer sound guidance member 525 face toward the protruding structures 528 of the inner sound guidance member 527 in such a way that they are not interferencing with each other while forming the curved and winding channels.

It shall be noted that during the generation of the sound by the acoustic box main body 100 due to vibrations, the sound is transmitted to the resonance chamber 524 and also enters into the curved and winding channels formed by the plurality of protruding structures 526, 528 such that the sound is further transmitted out of the acoustic box main body 100 via the plurality of rear drum units 529.

Figure 6:
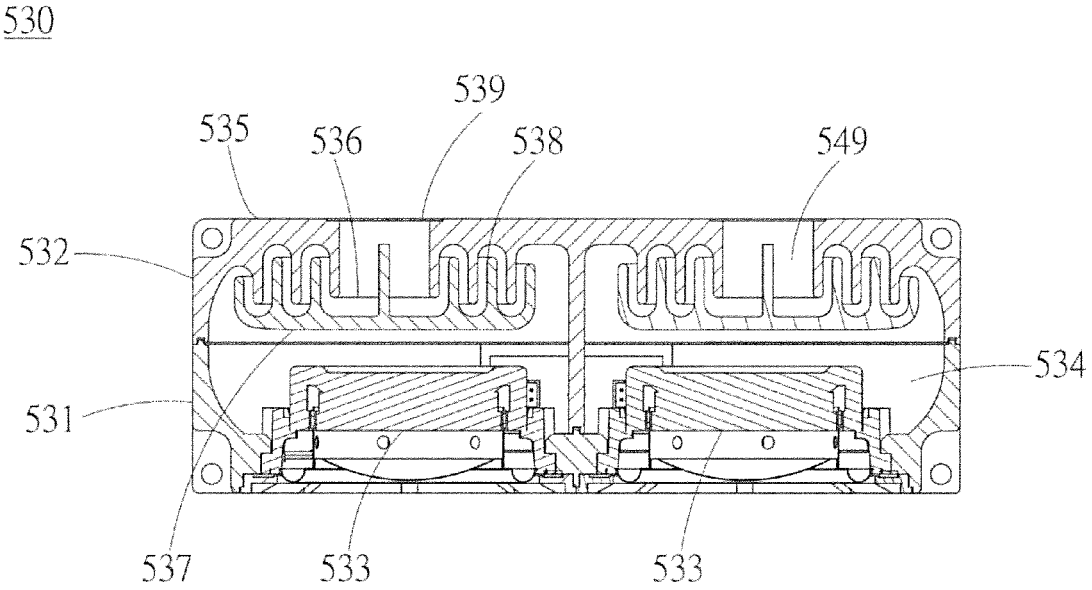
FIG. 6 is cross sectional view of a first speaker compartment of the acoustic box structure of the present invention.

Please refer to FIG. 6, showing of a cross sectional view of a first speaker compartment of the acoustic box structure of the present invention. The actuation principle of the second speaker compartment 530 is generally identical to those of the second speaker compartment 520 and the third speaker compartment 510, and its difference mainly relies in that the first speaker compartment 530 is mainly constructed by at least one speaker main body 533, a first resonance chamber 531 and a second resonance chamber 532.

The first resonance chamber 531 includes the plurality of speaker main bodies 533 disposed therein, and the first resonance chamber 531 also includes a pair of symmetrical outer sound guidance members 535. The second resonance chamber 532 is covered onto the first resonance chamber 531 and the speaker main bodies 533 in order to form a resonance enclosure 534 with the first resonance chamber 531. In addition, one side of the second resonance chamber 532 includes an inner sound guidance member 537 corresponding to the outer sound guidance member 535, and another side thereof includes a ventilation hole 549 corresponding to the inner sound guidance member 537. In addition, it is special in that the area of the speaker main body 533 facing toward the base member 120 includes a rear drum unit 539. Wherein, the outer sound guidance member 535 and the inner sound guidance member 537 respectively include a plurality of protruding structures 536, 538 arranged spaced apart from each other in curved shapes. Furthermore, the protruding structures 536 of the outer sound guidance member 535 face toward the protruding structures 538 of the inner sound guidance member 537 in such a way that they are not interferencing with each other while forming the curved and winding channels.

It shall be noted that during the generation of the sound by the acoustic box main body 100 due to vibrations, the sound is transmitted to the resonance chamber 534 and also enters into the curved and winding channels formed by the plurality of protruding structures 536, 538 such that the sound is further transmitted out of the acoustic box main body 100 via the ventilation hole 549 the plurality of rear drum units 539.

Another key feature of the present invention is that the plurality of speaker main bodies 513, 523, 533 of the third speaker compartment 510, the second speaker compartment 520 and the first speaker compartment 530 can be directly and integrally formed on the plurality of first resonance chambers 511, 521, 531 such that the manufacturing process efficiency is increased; alternatively, they can also be adhered onto the plurality of first resonance chambers 511, 521, 531.

Figure 7:
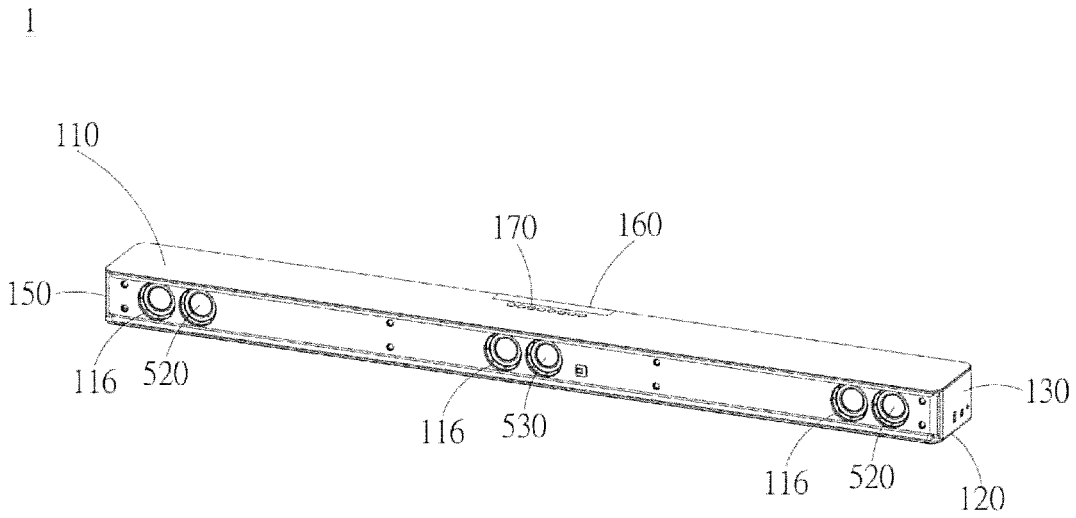
FIG. 7 is an assembly view of the acoustic box structure of the present invention.

Please refer to FIG. 7, showing an assembly view of the acoustic box structure of the present invention. The speaker module 500 is disposed on the connecting terminals 710 of the acoustic box connecting board 400, and the circuit main board 300 is disposed on the modular supporting plate 200 while being electrically coupled to the speaker module 500. Then, the cover member 110 and side panel 130 are covered onto the speaker module 500 and the modular supporting plate 200 in order to form an elongated shape of a modern appearance. In addition, the speaker module can be any one of the following of a full-range speaker, a woofer unit, a heavy subwoofer unit, a tweeter unit and a combination thereof.

The abovementioned embodiments are provided to illustrate the principles and exemplary methods of manufacturing or formation method of the present invention only. The scope of the present invention shall be defined by the claims recited hereafter, and any modifications or variations to the tenors or wordings recited in the claims shall be considered as their relevant equivalence and are within the scope of the present invention.

The scope of the present invention shall be determined by the content of the claims recited hereafter.

What is claimed is:

1. An acoustic box structure, comprising:

an acoustic box main body comprising a cover member and a base member with a cut-out slot formed thereon, and the acoustic box main body forming a hollow cavity constructed by the cover member and the base member having a pair of side panels covered onto two lateral sides thereof;

a modular supporting plate formed by a pair of side plates extended vertically from two lateral sides of a substrate and comprising a top plate extended vertically from one of the plurality of side plates and the substrate correspondingly; the modular supporting plate configured to be disposed inside the hollow cavity of the acoustic box main body;

a circuit main board comprising a processor, a plurality of connecting sockets and a plurality of connecting terminals formed thereon, and the circuit main board configured to be disposed on the modular supporting plate;

an acoustic box connecting board comprising the plurality of connecting terminals, the plurality of connecting terminals electrically coupled to the plurality of connecting sockets on the circuit main board, and the acoustic box connecting board configured to be inserted into the cut-out slot of the base member of the acoustic box main body; and a speaker module comprising at least one speaker compartment, the at least one speaker compartment configured to be fastened onto the base member of the acoustic box main body and comprising the plurality of connecting terminals corresponding to the plurality of connecting sockets of the modular supporting plate in order to be electrically coupled thereto.

2. The acoustic box structure according to claim 1, wherein a top portion of the cover member includes a plurality of slot holes formed thereon.

3. The acoustic box structure according to claim 1, wherein a front side and a rear side of a bottom portion of the cover member respectively includes a front supporting slat and a rear supporting slat extended toward the hollow cavity.

4. The acoustic box structure according to claim 3, wherein one side of the cover member facing toward the front supporting slat includes a plurality of sound holes corresponding to the speaker module.

5. The acoustic box structure according to claim 2, wherein the cover member comprises a functional button, one side of the functional button is arranged corresponding to the circuit main board.

6. The acoustic box structure according to claim 2, wherein the cover member comprises a functional button securement plate, the functional button securement plate is configured to cover the plurality of slot holes.

7. The acoustic box structure according to claim 3, wherein the cover member comprises a speaker mesh, the speaker mesh is arranged corresponding to the front supporting slat.

8. The acoustic box structure according to claim 1, wherein the side panel comprises at least one first insertion slot connected to an external device.

9. The acoustic box structure according to claim 8, wherein the at least one first insertion slot is any one of the following of a USB-OUT connecting portion, a USB-IN connecting portion, a 3.5 mm audio output hole connecting portion, a SD card insertion slot, a Mini-USB insertion slot, a Micro-USB insertion slot and a combination thereof.

10. The acoustic box structure according to claim 1, wherein modular supporting plate comprises a second insertion slot and a third insertion slot.

11. The acoustic box structure according to claim 10, wherein the second insertion slot is a power socket.

12. The acoustic box structure according to claim 10, wherein the third insertion slot is any one of the following of an audio terminal insertion slot, a video terminal insertion slot, a USB terminal insertion slot, a VGA insertion slot, a HDMI insertion slot and a combination thereof.

13. The acoustic box structure according to claim 1, wherein the circuit main board comprises a wireless module panel, an amplifier functional board, a power supply panel, a functional control board, an input output interface board, an infrared receiver, a NFC chipset and a combination thereof.

14. The acoustic box structure according to claim 9, wherein a circuit layer of the first insertion slot further comprises an electrical terminal electrically coupled to the first insertion slot of the side panel.

15. The acoustic box structure according to claim 1, wherein the speaker module is any one of the following of a full-range speaker, a woofer unit, a heavy subwoofer unit, a tweeter unit and a combination thereof.

* * * * *